US005115701A

United States Patent [19]

Lehnert

[11] Patent Number: 5,115,701

[45] Date of Patent: May 26, 1992

[54] DRIVE MECHANISM AND STRAIN GAUGE MOUNTING FOR A NUTRUNNER APPLIANCE

[75] Inventor: Mark W. Lehnert, Hoffman Estates, Ill.

[73] Assignee: GSE, Inc., Farmington Hills, Mich.

[21] Appl. No.: 758,403

[22] Filed: Aug. 30, 1991

Related U.S. Application Data

[63] Continuation of Ser. No. 590,501, Sep. 26, 1990, abandoned, which is a continuation of Ser. No. 310,952, Feb. 10, 1989, abandoned.

[51] Int. Cl.[5] ..... B25B 23/14

[52] U.S. Cl. ..... 81/467; 81/469; 81/57.13; 73/862.21

[58] Field of Search ..... 81/467, 469–470, 81/57.13, 57.28, 57.29; 173/12; 73/862.21, 862.23, 863.35

[56] References Cited

U.S. PATENT DOCUMENTS 2,808,749 10/1957 Lampke ..... 81/57.13
4,084,429 4/1978 Boland ..... 81/57.13 X
4,311,072 1/1982 Hudgins ..... 81/57.29 X
4,544,039 10/1985 Crane ..... 81/467 X
4,620,449 11/1986 Borries et al. ..... 73/862.21
4,648,282 3/1987 Alender et al. ..... 73/862.23
4,805,404 2/1989 Dupin ..... 81/470 X

*Primary Examiner*—D. S. Meislin
*Attorney, Agent, or Firm*—Krass & Young

[57] ABSTRACT

Generally there is provided an improved design for a nutrunner appliance drive mechanism and strain gauge mounting. The design for the drive mechanism and strain gauge mounting of the nutrunner appliance facilitates placement of the strain gauge nearer the nut engagement extremity. The drive mechanism includes a shaft member mounted at an angle transverse to the motor shaft, and having a beveled gear at one extremity and a nut engaging member on the other extremity. A strain gauge is mounted between these extremities and provides signals to contacts rotating with the shaft. A brush contact protruding from a removable terminal block is used to pick up the electrical signals from the strain gauge contacts.

14 Claims, 2 Drawing Sheets

DRIVE MECHANISM AND STRAIN GAUGE MOUNTING FOR A NUTRUNNER APPLIANCE

This is a continuation of co-pending application Ser. No. 590,501 filed on Sept. 26, 1990, now abandoned, which was a continuation of Ser. No. 310,952 filed Feb. 10, 1989, now abandoned.

BACKGROUND OF THE INVENTION

1. Field of the Invention

This invention relates generally to appliances commonly referred to as nutrunners and used in manufacturing for applying and securing nuts to bolts during assembly operations. More particularly, this invention relates to improvements in the drive mechanism and a strain gauge mounting in order to provide improved control of the performance of the appliance.

2. Description of the Prior Art

Prior nutrunner drive apparatus has been characterized by an electrically powered motor having a strain gauge mounted to the motor shaft between the motor and drive gearing of the appliance. This gauge is used to provide an electrical output corresponding to the torque being delivered by the motor. In such nutrunner devices, the gearing is used to alter the direction of the drive to deliver torque at a right angle to the longitudinal axis of the appliance. In these devices, due to frictional losses in the drive mechanism, the torque delivered by the motor and measured by the strain gauge is not the same as the torque ultimately delivered by the appliance to the nut. As a result, control of the motor and the torque delivered to the nut becomes inaccurate.

With the configuration of prior designs, movement of the strain gauge mounting to a location nearer the nut engagement produces interference with the location of the gearing and difficulty in routing wires to the gauge.

SUMMARY OF THE INVENTION

It is accordingly the principal object of the present invention to provide a design for the drive mechanism and strain gauge mounting of the nutrunner appliance which facilitates placement of the strain gauge nearer the nut engagement extremity.

Generally there is provided an improved design for a nutrunner appliance drive mechanism and strain gauge mounting. The drive mechanism includes a shaft member mounted at an angle transverse to the motor shaft, and having a beveled gear at one extremity and a nut engaging member on the other extremity. A strain gauge is mounted between these extremities and provides signals to contacts rotating with the shaft. A brush contact protruding from a removable terminal block is used to pick up the electrical signals from the strain gauge contacts.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Figure 1:
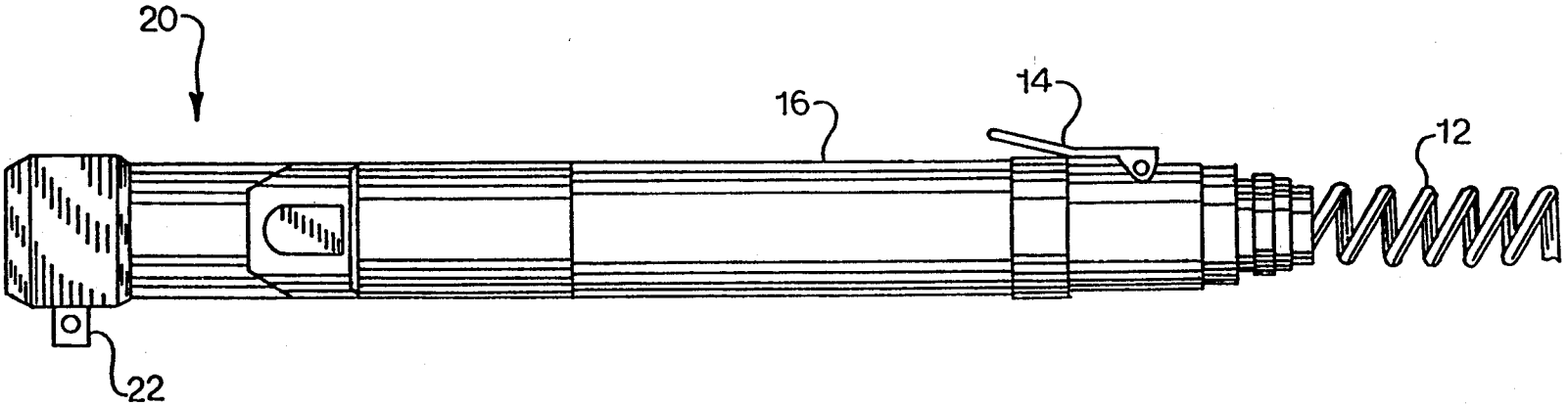
FIG. 1 is a perspective view of the nutrunner appliance of the present invention.

Turning now to the drawings, a hand held nutrunner appliance is shown in FIG. 1 and generally includes a power and control system connection 12, a manually operational switch 14, a mid section body 16 enclosing the motor, and the drive extremity housing 20 of the appliance. This drive housing encloses a drive mechanism and a torque sensor, as hereinafter described, and is arranged to present a torque monitored nut engagement member 22 at an angle transverse to the longitudinal axis of the appliance.

Figure 2:
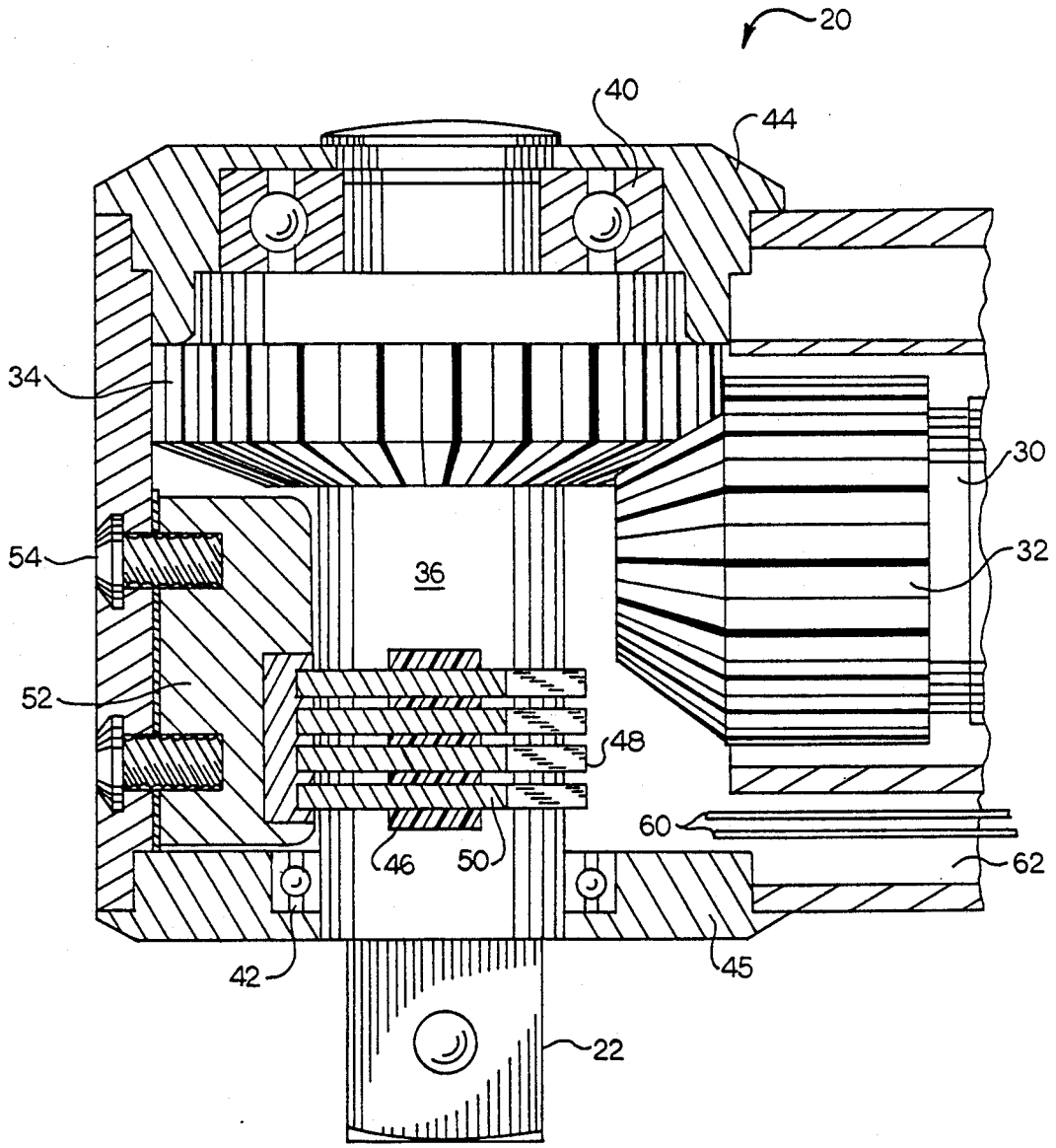
FIG. 2 is a cross sectional view of the drive mechanism of the nutrunner appliance of FIG. 1.

The drive mechanism, shown in cross section in FIG. 2, includes a motor shaft 30 projecting from a controlled electrical motor enclosed within the appliance body. This motor shaft presents a beveled gear 32 to transmit torque from the motor. A mating gear 34 positioned to engage the motor shaft gear is carried on a drive shaft 36 mounted within the drive housing on bearings 40 and 42. The drive shaft, bearing and gears are all enclosed within the drive housing, and the assembly is secured by end plates 44 and 45.

In accordance with the invention a strain gauge 46 is secured to the shaft, in a manner well known in the art, and provides electrical signals proportional to the strain in the drive shaft reflecting the torque being transmitted therethrough. The strain gauge output signal is electrically communicated to contacts 48 affixed to the shaft to rotate therewith. These contacts are preferably ring members and are electrically connected via electrically conductive tactile brushes or fingers 50 to the terminal block 52. (Holding this block in place are end screws 54 which, when released, allow the block to be removed through the end plate covered opening.)

With the above strategic placement of the strain gauge and its contacts, control wiring 60 is fed along a cavity 62 in the appliance body and routed around the drive shaft assembly to the terminal block.

From the foregoing description, it will be apparent that modifications can be made to the apparatus and method for using same without departing from the teaching of the present invention. Accordingly the scope of the invention is only to be limited as necessitated by the accompanying claims.

I claim:

1. A nutrunner appliance comprising:

a motor having a motor shaft driven thereby, said motor shaft carrying gear means affixed to the forward extremity thereof;

a drive shaft mounted transverse to said motor shaft, said drive shaft carrying bevel gear means affixed at a first extremity thereof, said drive shaft gear means being arranged to engage said gear means of said motor shaft, and said drive shaft further having nut engagement means affixed to the second extremity thereof; the bevel gear means tapering inwardly toward said second extremity; and strain gauge means affixed to said drive shaft proximate said nut engagement means for detecting strain in said drive shaft caused by torque transmitted to said nut engagement means and developing an electrical signal proportional to the torque transmitted to said nut engaging means, and a signal receiver affixed to a non-rotating housing surrounding said drive shaft proximate said nut engagement means to receive the signal transmitted from said strain gauge means.

2. The nutrunner appliance of claim 1 wherein said strain gauge means comprises a strain gauge element mounted to said drive shaft and arranged to provide electrical signals to strain gauge contacts on said shaft, and further comprising electrical contact means arranged to provide tactile electrical contact to said strain gauge contacts throughout the rotation of said drive shaft.

3. The nutrunner appliance of claim 2 wherein said electrical contact means comprises electrically conductive projections from a block member mounted, to a housing surrounding said drive shaft, proximate said drive shaft.

4. The nutrunner appliance of claim 3 wherein said block member, drive shaft, and gears are mounted within a housing having an end plate removably mounted thereto to provide access to the block member, drive shaft, and gears.

5. The nutrunner appliance of claim 4 further comprising screw means arrange to project through said housing to secure said block member thereto.

6. The nutrunner appliance of claim 3 further comprising wiring means directed through a channel in said appliance and routed to said block member to provide electrical contact to said electrically conductive projections at said block member.

7. A nutrunner appliance comprising:

an elongate housing having a motor and a motor shaft extending axially through the housing and driven by said motor;

a bevel pinion mounted on the motor shaft for rotation with said motor shaft;

a non-rotating drive housing attached to and carried at essentially right angles to said elongate housing;

a drive shaft disposed in said drive housing and having opposite top and bottom ends, a bevel gear mounted on said drive shaft mediate said top end and said bevel pinion to mesh with said bevel pinion proximate said top end;

a tool engaging element driven by said drive shaft and mounted proximate the bottom end of said drive shaft for engagement with a threaded fastener to be driven;

sensor means rotatable with said drive shaft and attached to said drive shaft mediate said bevel gear and said tool engaging element for developing an electrical signal representing torque instantaneously transmitted by said drive shaft; and means for transferring said electrical signal from said rotating sensor means to a signal receiver mounted on said non-rotating drive housing mediate the bevel gear and the tool engaging element.

8. Apparatus as defined in claim 7 wherein said means for transferring said electrical signal from said rotating sensor means to said non-rotating drive housing are mounted on said drive shaft in said drive housing mediate the bevel gear and the tool engaging element.

9. A nutrunner appliance comprising:

an elongate housing having a motor and a motor shaft extending axially through the housing and driven by said motor;

a bevel pinion mounted on the motor shaft axis for rotation with said motor shaft;

a non-rotating drive housing attached to and carried at essentially right angles to said elongate housing;

a drive shaft disposed in said drive housing and having opposite top and bottom ends, a bevel gear mounted on said drive shaft proximate the top end to mesh with aid bevel pinion proximate said top end;

a tool engaging element driven by said drive shaft and mounted proximate the bottom end of said drive shaft for engagement with a threaded fastener to be driven;

sensor means rotatable with said drive shaft and attached to said drive shaft mediate said bevel gear and said tool engaging element for developing an electrical signal representing torque instantaneously transmitted by said drive shaft;

means for transmitting said electrical signal from said rotating sensor means to said non-rotating drive housing, wherein said sensor means comprises at least one strain gage bonded to said shaft, wherein said means for transferring comprises slip rings mounted on said drive shaft mediate said bevel gear and said tool engaging element for rotation therewith, said slip rings being electrically connected to said strain gauge; and contact means mounted to said non-rotatable drive housing for contacting a peripheral surface of said slip rings for electrical signal transmission purposes.

10. Apparatus as defined in claim 7 wherein said non-rotatable drive housing comprises an axial end cap and fastener means for securing said end cap to said non-rotatable housing and for removing said end cap from said non-rotatable housing for access to said sensor means and said drive shaft.

11. Apparatus as defined in claim 10 wherein said non-rotatable drive housing further comprises cap means at said drive shaft top end, top end bearing means carried by said top cap for receiving and mounting the top end of said drive shaft for rotation.

12. Apparatus as defined in claim 7 further including a wiring channel disposed internally of said elongate housing and conductor means within said wiring channel connected electrically to said signal receiver.

13. A nutrunner appliance comprising an elongate housing having a motor and a motor shaft extending axially through the housing and driven by said motor;

a bevel pinion mounted on the motor shaft for rotation with said motor shaft;

a non-rotating drive housing attached to and carried at essentially right angles to said elongate housing;

a drive shaft disposed in said housing having opposite top and bottom ends, a bevel gear mounted on said drive shaft to mesh with said bevel pinion;

a tool engaging element driven by said drive shaft and mounted proximate the bottom end of said drive shaft for engagement with a threaded fastener to be driven;

a sensor mounted to and rotatable with said drive shaft, the sensor mounted to the drive shaft mediate the bevel gear and the tool engaging element, the sensor developing an electrical signal representing torque instantly transmitted by said drive shaft;

and a signal receiver mounted on the non-rotating drive housing mediate the bevel gear and the tool engaging element for receiving the output of the sensor.

14. The nutrunner appliance of claim 13 including a wiring housing totally encompassed within said elongate housing and a conductor disposed within said wiring housing, the conductor electrically connected to the signal receiver.

* * * * *